US007586443B2

(12) United States Patent
Takei

(10) Patent No.: US 7,586,443 B2
(45) **Date of Patent: *Sep. 8, 2009**

(54) LEAKAGE LOSS LINE TYPE CIRCULARLY-POLARIZED WAVE ANTENNA AND HIGH-FREQUENCY MODULE

(75) Inventor: Ken Takei, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 453 days.

This patent is subject to a terminal disclaimer.

(21) Appl. No.: 11/352,406

(22) Filed: Feb. 13, 2006

(65) Prior Publication Data

US 2006/0181467 A1 Aug. 17, 2006

(30) Foreign Application Priority Data

Feb. 14, 2005 (JP) ..... 2005-036000

(51) Int. Cl.
*H01Q 1/38* (2006.01)
*H01Q 9/38* (2006.01)

(52) U.S. Cl. ..... 343/700 MS; 343/830

(58) Field of Classification Search ..... 343/700 MS, 343/702, 829, 830, 833, 846, 850
See application file for complete search history.

(56) References Cited

U.S. PATENT DOCUMENTS 5,264,861 A 11/1993 Roederer et al.
5,526,007 A 6/1996 Murakami et al.
6,268,831 B1 * 7/2001 Sanford ..... 343/702
6,727,858 B2 4/2004 Iijima
6,791,506 B2 * 9/2004 Suganthan et al. ..... 343/795
7,119,747 B2 * 10/2006 Lin et al. ..... 343/702
7,123,203 B2 10/2006 Le Geoff et al.

FOREIGN PATENT DOCUMENTS

| | | |
|---|---|---|
| JP | 1-158805 | 6/1989 |
| JP | 5-152842 | 6/1993 |
| JP | 5-275918 | 10/1993 |
| JP | 2002-76765 | 3/2002 |
| JP | 2003-101341 | 4/2003 |
| JP | 2005-530439 | 10/2005 |
| WO | WO 2004/001900 | 12/2003 |

OTHER PUBLICATIONS

Japanese Office Action dated Oct. 21, 2008 with English translation.

* cited by examiner

*Primary Examiner*—Shih-Chao Chen
(74) *Attorney, Agent, or Firm*—McGinn IP Law Group, PLLC

(57) ABSTRACT

A leakage loss line type circularly-polarized wave antenna is provided with 3 or more conductor lines having losses caused by electromagnetic radiation and being connected to a single power feed point. The projection of the conductor lines onto a plane perpendicular to a straight line that connects the power feed point and one point in the distance is in a positional relationship so that the projection of at least one conductor line is perpendicular to the projection of the remaining conductor lines.

26 Claims, 11 Drawing Sheets

FIG. 16A
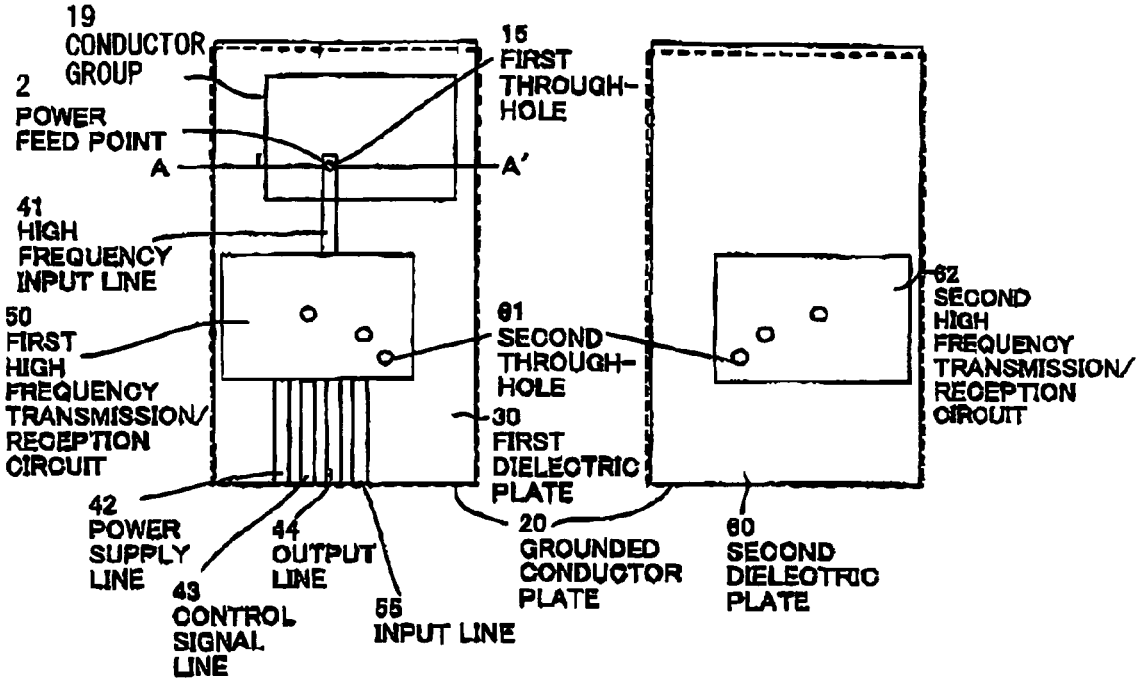
FIG. 16B
FIG. 16C
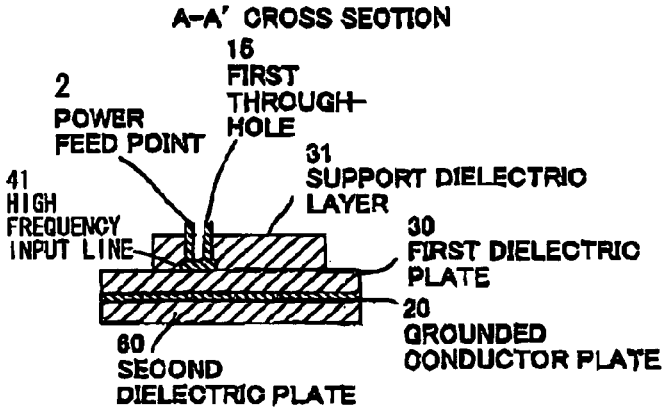

LEAKAGE LOSS LINE TYPE CIRCULARLY-POLARIZED WAVE ANTENNA AND HIGH-FREQUENCY MODULE

The present application is based on Japanese patent application No. 2005-036000, the entire contents of which are incorporated herein by reference.

BACKGROUND OF THE INVENTION

1. Field of the Invention

The present invention relates to a leakage loss line type circularly-polarized wave antenna applied to wireless devices which provide users with wireless system services using circularly-polarized waves, such as satellite broadcast and satellite position information systems, and a high-frequency module or a wireless terminal into which is incorporated the same antenna. In particular, it relates to a small-size and thin leakage loss line type circularly-polarized wave antenna, suitable for providing users with information wireless system services using as a medium electromagnetic waves with long wavelengths compared with dimensions of the above wireless devices, and a high-frequency module including the antenna, and a wireless terminal into which are incorporated the antenna and the high-frequency module.

2. Description of the Related Art

Among various wireless systems, services using satellites have advantages of being capable of providing seamless services covering each country, having less screening effects of high-rise buildings because electromagnetic waves that serve as a medium arrive from substantially a zenith direction, etc. which are utilized for operating many systems such as seamless international calls, satellite broadcast, positioning systems, etc.

These systems can provide international seamless services, but have inevitably high possibilities of electromagnetic waves leaking to other countries or other regions. For this reason, in order to cope with such an electromagnetic wave leak problem, circularly-polarized waves are used to assign different polarized waves (right-handed and left-handed circularly-polarized waves) to adjacent countries or regions.

Right-handed circularly-polarized waves cannot be received by left-handed circularly-polarized wave antennas, and left-handed circularly-polarized waves cannot be received by right-handed circularly-polarized wave antennas. Also, linearly-polarized wave antennas can receive only a half of power of circularly-polarized waves.

For this reason, to provide users with wireless services using circularly-polarized electromagnetic waves efficiently, realization of a circularly-polarized wave antenna is important.

To realize a circularly-polarized wave antenna, 2 conventional methods are known, and widely practically used.

The first method is to position 2 linearly-polarized wave antennas perpendicularly to each other so that respective power feed phases of the antennas are shifted by 90 degrees. As this representative realized example, there is a famous cross dipole, which requires 2 power feed portions, and a means (e.g. a phase shifter) for shifting respective phases of the power feed portions by 90 degrees, which results in a large-scale circuit of a wireless device to which is applied an antenna, i.e., the problem with a size reduction of the same wireless device, as shown in Naohisa Goto, "ZUSETU ANTENNA", IEICE, 1995, p. 219, for example.

The second method is to use an open-periphery patch antenna such as a micro-strip antenna, in which a circularly-polarized wave antenna is realized by 1 power feed point using a rectangular or circular two-dimensional patch which extends in two perpendicular axes. As shown in Misao Haneishi, "KOGATA HEIMEN ANTENNA", IEICE, 1996, pp. 143-145, for example, by deforming a square or circular shape short on one side and long on the other respective to two perpendicular axes, one side of the square or half the perimeter of the circle is made different, so that the respective lengths are slightly longer or shorter than ½ of a wavelength of a radio wave to be received by an antenna, thereby shifting the respective power feed phases for these lengths by 90 degrees in one point power feed, as inductivity or capacitivity for the respective lengths perpendicular to each other respective to a power feed point.

This method has one power feed point compared to the first method, and therefore realizes a substantial scale reduction of a high-frequency circuit that feeds high-frequency power to the antenna, and is most practically used at present.

When this method is used, however, because it requires two-dimensionally ensuring antenna dimensions of substantially ½ of a wavelength of a radio wave to be received by an antenna (i.e., ensuring the area of the square having one side of substantially ½ of the wavelength), there is still the problem with the application to modern palm small-size terminals.

To reduce antenna dimensions in this method, by lining or covering an antenna with a dielectric having a high dielectric constant, a technique for reducing antenna size is developed by a wavelength-reducing effect of the dielectric. However, there arise the new problems of a cost increase due to use of the dielectric having a high dielectric constant, and a dimension increase in a thickness direction of the dielectric for maximally deriving wavelength-reducing effect of the dielectric.

SUMMARY OF THE INVENTION

Accordingly, it is an object of the present invention to provide a leakage loss line type circularly-polarized wave antenna, which is capable of realizing a circularly-polarized wave antenna that provides users with wireless services using circularly-polarized electromagnetic waves, such as satellite wireless systems, in the simplest one point power feed, in small-size and thin dimensions, and without the addition of another medium for a wavelength reduction that tends to cause a cost increase of a dielectric, etc., and a high-frequency module or a wireless terminal using the same circularly-polarized wave antenna.

(1) According to one aspect of the invention, a leakage loss line type circularly-polarized wave antenna comprises:

3 or more conductor lines having losses caused by electromagnetic radiation and being connected to a single power feed point, wherein:

the projection of the conductor lines onto a plane perpendicular to a straight line that connects the power feed point and one point in the distance is in a positional relationship so that the projection of at least one conductor line is perpendicular to the projection of the remaining conductor lines.

(2) According to another aspect of the invention, a leakage loss line type circularly-polarized wave antenna comprises:

3 or more conductor lines having losses caused by electromagnetic radiation and being connected to a single power feed point, wherein:

the conductor lines are projected onto a plane perpendicular to a straight line that connects the power feed point and one point in the distance;

the sum of the projections of high-frequency current induced on the conductor lines onto any 2 orthogonal axes set on the plane of complex vectors is taken for each axis;

the ratio of the absolute values for the amplitude of each sum is 0.7–1.3; and the absolute value of the phase difference in the axes is 80-100 degrees.

In the above inventions (1) and (2), the following modifications and changes can be made.

(a) A finite grounded conductor is included, and one end of at least one of the conductor lines is grounded to the grounded conductor.

(b) A finite grounded conductor is included, and the conductor lines are all open at the other end to the power feed side.

(c) The finite grounded conductor and the conductor lines are coplanar.

(d) The projection of each conductor line onto the plane is curved at the same ratio and in the same direction.

(e) The curved shape of each conductor line comprises a circular continuous portion.

(f) The projection of each conductor line onto the plane is bent at the same ratio and in the same direction.

(g) The bent shape of each conductor line comprises a square continuous portion.

(h) The number of the conductor lines is 3.

(i) The number of the conductor lines is 4.

(j) Each conductor line is formed on a conductor plate having finite ground potential.

(k) The space between each conductor line and the conductor plate is filled with a dielectric.

(l) The space between each conductor line and the conductor plate is filled with a magnetic material.

(m) The antenna structure is laminated with a thin dielectric sheet.

(n) One end of a coaxial cable is connected to the power feed point, while the other end is a power feed point for external connection.

(o) One end of a flexible print cable is connected to the power feed point, while the other end is a power feed point for external connection.

(p) A dielectric-stacked conductor is formed on a surface in the power feed portion direction of the grounded conductor plate, and a conductor connected to the power feed portion is formed inside the dielectric, and electrically connected to the stacked conductor.

(q) A magnetic material-stacked conductor is formed on a surface in the power feed portion direction of the grounded conductor plate, and a conductor connected to the power feed portion is formed inside the magnetic material, and electrically connected to the stacked conductor.

(r) A dielectric-stacked conductor is formed on a surface in the power feed portion direction of the grounded conductor plate, and a conductor connected to the power feed portion is formed on a side of the dielectric, and electrically connected to the stacked conductor.

(s) A magnetic material-stacked conductor is formed on a surface in the power feed portion direction of the grounded conductor plate, and a conductor connected to the power feed portion is formed on a side of the magnetic material, and electrically connected to the stacked conductor.

(3) According to one aspect of the invention, a high-frequency module comprises the leakage loss line type circularly-polarized wave antenna according to the above inventions (k), (l), (p)-(s).

(4) According to another aspect of the invention, a mobile wireless device comprises the leakage loss line type circularly-polarized wave antenna according to the above inventions (1), (2), (a)-(s), or the high-frequency module according to the above invention (3).

<Advantages of the Invention>

According to the present invention, since a one point power feed circularly-polarized wave antenna can be realized in small dimensions, and without using a wavelength reduction member, a small-size circularly-polarized antenna wave is realized without causing a new cost increase, and a thin module containing a small-sized and thinned antenna is realizable, and the same antenna and module is therefore used in small-sized and thinned wireless terminals of wireless systems using circularly-polarized waves.

BRIEF DESCRIPTION OF THE DRAWINGS

The preferred embodiments according to the invention will be explained below referring to the drawings, wherein:

FIGS. 16A, 16B and 16C are a plan view, a backside view and a cross-sectional view, respectively, of a high-frequency module according to one embodiment of the present invention;

DETAILED DESCRIPTION OF THE PREFERRED EMBODIMENTS

Figure 1:
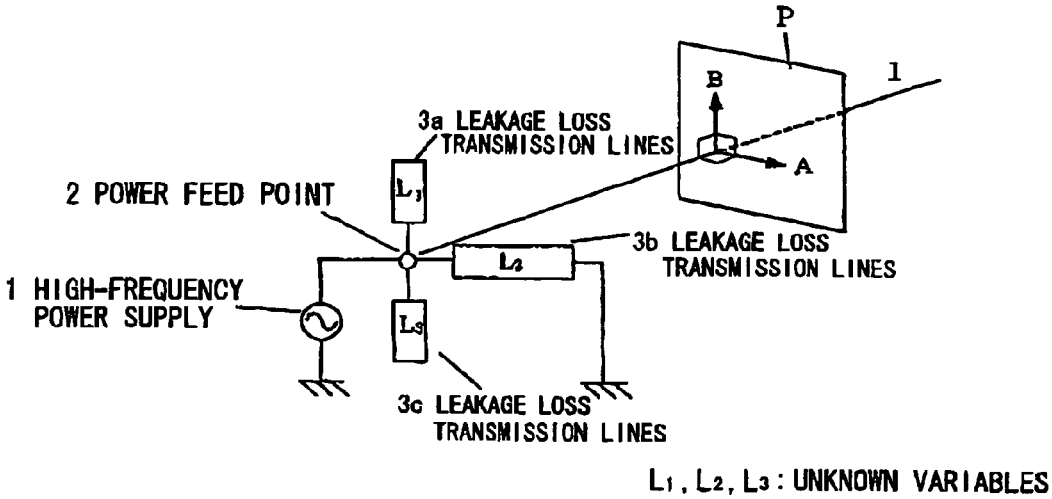
FIG. 1 is a configuration diagram of a leakage loss line type circularly-polarized wave antenna according to the present invention.

First, a basic principle of the present invention will be explained.

As shown in JP-A-01-158805, the electrical structure of an antenna can be described with a leakage loss transmission line.

The same leakage loss transmission line is expressed by formula (1).

$$Z_c = \tan(\beta L - j\alpha L^n) \quad (1),$$

Where $Z_c$ is characteristic impedance, $\beta$ a propagation constant, $\alpha$ a loss constant, n a non-linear leakage coefficient and L a line length.

Formula (1) means that, where an antenna comprises leakage loss transmission lines, in other words, where an antenna with one dimensional electric current distribution comprises sets of conductor lines having width considered to be sufficiently thin compared with wavelength used, when formula (1) is resolved into an imaginary part and a real part, the impedance of each line respective to a power feed point can be resolved into a reactance element and a resistive element.

To show this clearly, consider plural transmission line groups each comprising one or more leakage loss transmission lines, which are connected to a power feed point.

Each transmission line group can be resolved into a reactance element and a resistive element, as mentioned above. For clarity of the gist, a circuit can be expressed in terms of admittance, where admittances, the number of which corresponds to the number of transmission line groups, are connected in parallel to the only power feed point.

From the point of view of an antenna, as the admittance is that of a parallel circuit of conductance (a real part) and susceptance (an imaginary part), the matching condition at the power feed point is that the sum of susceptances is zero, and the complete matching is realized when the sum of susceptances is equal to the value of characteristic impedance of a high-frequency circuit section.

Where the electrical lengths of transmission lines constituting transmission line groups are small (specifically less than ½ wavelength) compared with wavelength corresponding to frequency at which the antenna operates, phases of high-frequency current induced on the transmission line groups are considered to be the same. Accordingly, when viewed from the power feed point, current induced on each transmission line group has an individual amplitude and phase and flows to the power feed point.

From the point of view of reception of a circularly-polarized wave, on the other hand, the circularly-polarized wave refers to a phenomenon of electromagnetic waves for 2 mutually-perpendicular axes set in a plane perpendicular to an arriving direction of a circularly-polarized wave and which have the same intensity and are out of phase by 90 degrees.

According to electromagnetics, as current flowing on a conductor and electromagnetic electric field produced by the same current are in the same direction in the distance, the sets of thin-width conductor lines constituting an antenna (substantially the above transmission line groups) are projected onto a plane perpendicular to a straight line that connects a power feed point and one point in the distance, and the sum of projections of high-frequency current induced on each conductor line, which is sufficiently short compared with wavelength, onto any 2 orthogonal axes set on the above plane of complex vectors, is taken for each axis. If the amplitude of each sum is the same and the phase difference thereof is 90 degrees, then the sets of thin-width conductor lines may be considered to be a circularly-polarized wave antenna.

Looking at the induced current flowing from the power feed point to each transmission line group, because these circularly-polarized wave conditions are the very same conditions with respect to the amplitude and phase of the induced current, use of susceptance and conductance components in the admittance expression of each transmission line group allows the amplitude to be easily obtained by square mean of these and the phase to be easily obtained by arctangent of the ratio of these.

In antennas using the above new principle using the concept of a leakage loss transmission line, because of one power feed point and no restriction "dimensions of substantially ½ of wavelength" explained in the Background of the Invention, there occurs the possibility of realizing a small-size antenna that breaks the dimension limit of the prior art.

For instance, in the configuration comprising 3 leakage loss transmission lines 3*a*, 3*b*, and 3*c* shown in FIG. 1, L1, L2, and L3 are unknown design variables, which are determined from 3 conditions: (1) Susceptance is zero at a power feed point; (2) The amplitude of current induced on (flowing to) L1 and L3 is equal to the amplitude of current induced on (flowing to) L2; (3) The phase of current induced on (flowing to) L1 and L3 is different from the phase of current induced on (flowing to) L2 by 90 degrees. L1, L2, and L3 are respectively substantially ⅓, ¼, and ⅙ of use wavelength under the conditions that the use frequency of an antenna is 1.5 GHz, and the leakage loss coefficient $\alpha=0.001\beta$.

Figure 2:
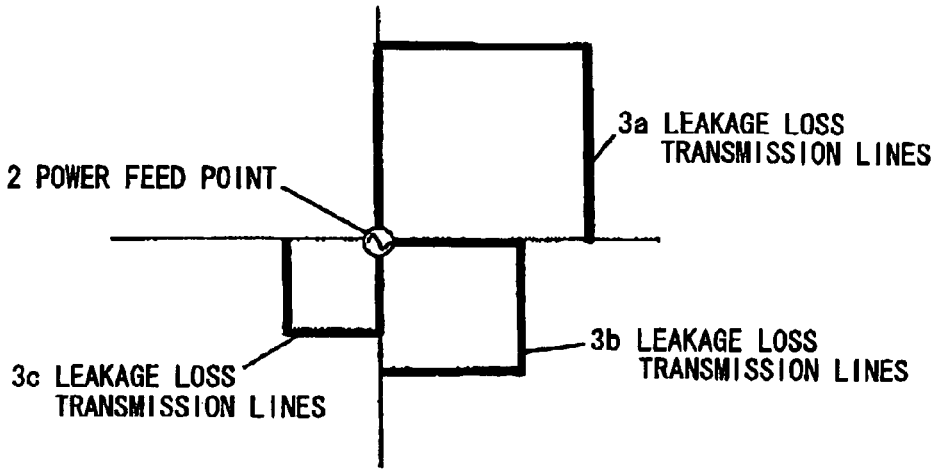
FIG. 2 is a structural diagram of a leakage loss line type circularly-polarized wave antenna according to the present invention.

With FIG. 1, although the size reduction of $(⅓+⅙)\times¼=½\times¼$ is realized already, since even superposing on a circularly-polarized wave another circularly-polarized wave in the same direction results in a circularly-polarized wave, the U-shape structure introduced as in FIG. 2 allows a substantial size reduction to be achieved compared to the prior art of $(⅓+¼)/3\times(⅓+⅙)\sim⅕\times⅙$.

The result obtained by the present invention shows that a one point power feed circularly-polarized wave antenna can be realized in much smaller dimensions than those of conventional antennas (i.e., a square having one side of substantially ½ of use wavelength), and without using a wavelength reduction member such as a dielectric, and demonstrates that a small-size circularly-polarized antenna wave is realized without causing a new cost increase.

Next, one embodiment of the present invention will be explained referring to FIG. 1.

FIG. 1 is a diagram showing configuration of one embodiment of a leakage loss line type circularly-polarized wave antenna according to the present invention, which simulates a high-frequency circuit connected to the antenna, and in which a high-frequency power supply 1 is connected to a power feed point 2, while leakage loss transmission lines 3*a*, 3*b*, and 3*c* are connected to the power feed point 2 and in parallel to the high-frequency power supply 1.

The leakage loss transmission lines 3*a* and 3*c* are open at a distal end, while the leakage loss transmission lines 3*b* is shorted at a distal end. The leakage loss transmission lines 3*a* and 3*c* are spatially collinearly arranged, while the leakage loss transmission lines 3*b* is arranged spatially perpendicularly to the leakage loss transmission lines 3*a* and 3*c*.

A plane P is taken perpendicularly to a straight line 1 that connects a power feed point 2 at which a circularly-polarized wave arrives and one point in the distance. Leakage loss transmission lines 3*a*, 3*b*, and 3*c* are projected onto the plane P, and the sum of the projections of high-frequency current induced on each leakage loss transmission lines 3*a*, 3*b*, and 3*c*, onto any 2 orthogonal axes A and B set on the above plane P of complex vectors is taken for each axis. If the amplitude of each sum is the same in the axes A and B (specifically, the ratio of the absolute values of the sums of each axis is 0.7–1.3, preferably 0.9–1.1), and the phase difference between the axes A and B is substantially 90 degrees (specifically, the absolute value of the difference between the sum of each axis and argument is 80-100 degrees), then a circularly-polarized wave antenna is formed.

This embodiment has the effect of realizing a circularly-polarized wave antenna with the least number of leakage loss transmission lines, since it is possible to realize, with the least unknown number 3, the 3 conditions that reactance is zero at the power feed point 2, that the amplitudes of mutually spatially perpendicular high-frequency induced currents are equal, and that the phase difference is 90 degrees.

Another embodiment of the present invention will be explained referring to FIG. 2.

FIG. 2 is a diagram showing structure of another embodiment of a leakage loss line type circularly-polarized wave antenna according to the present invention, in which the antenna structure is projected onto a plane parallel to a plane perpendicular to a straight line that connects a power feed point 2 and one point in the distance.

Leakage loss transmission lines 3*a* and 3*b* and a leakage loss transmission line 3*c* are connected to the power feed point 2, while the leakage loss transmission line 3*b* and the leakage loss transmission lines 3*a* and 3*c* are perpendicular in each portion when viewed in a direction receding from the power feed point 2. Since even super posing on a circularly-polarized wave another circularly-polarized wave in the same direction results in a circularly-polarized wave, if the leakage loss transmission lines 3*a*, 3*b*, and 3*c* of this embodiment satisfy the electrical conditions of the embodiment of FIG. 1, it is possible to radiate a circularly-polarized wave into space.

This embodiment allows the entire antenna to be formed in small volume compared with the example where the leakage loss transmission lines 3*a*, 3*b*, and 3*c* of FIG. 1 are all linearly arranged, thereby having the effect of realizing a small-size a circularly-polarized wave antenna.

Another embodiment of the present invention will be explained referring to FIG. 3.

Figure 3:
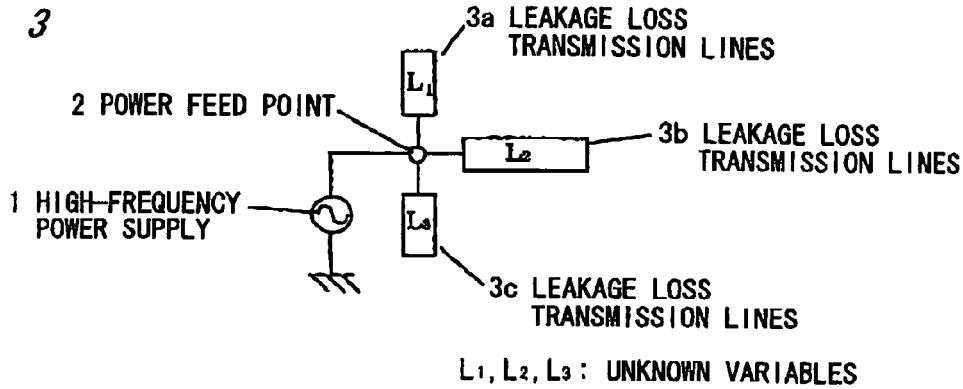
FIG. 3 is a configuration diagram of a leakage loss line type circularly-polarized wave antenna according to the present invention.

FIG. 3 is a diagram showing configuration of another embodiment of a leakage loss line type circularly-polarized wave antenna according to the present invention, which is different from the embodiment of FIG. 1 in that leakage loss transmission lines 3*a*, 3*b*, and 3*c* constituting an antenna are all open at a distal end.

Since all the leakage loss transmission lines 3*a*, 3*b*, and 3*c* constituting an antenna are open, the circularly-polarized wave antenna according to this embodiment can be operated at a position distant from the high-frequency circuit without requiring a particular grounded conductor.

Another embodiment of the present invention will be explained referring to FIG. 4.

Figure 4:
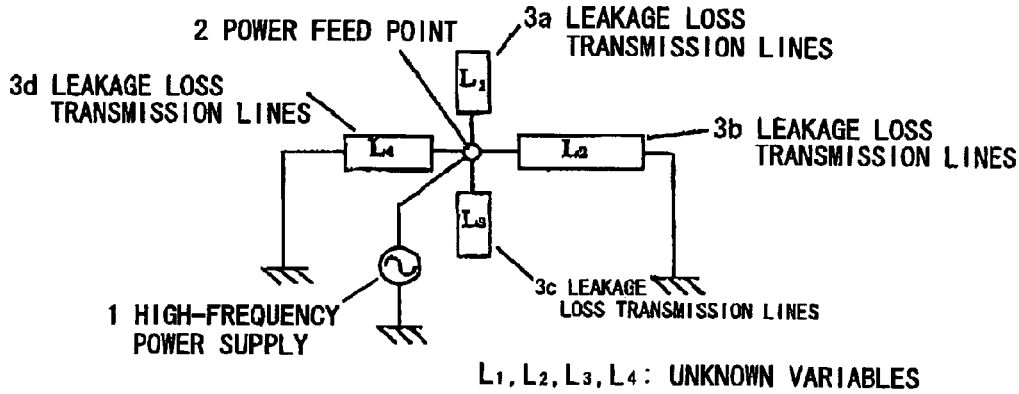
FIG. 4 is a configuration diagram of a leakage loss line type circularly-polarized wave antenna according to the present invention.

FIG. 4 is a diagram showing configuration of another embodiment of a leakage loss line type circularly-polarized wave antenna according to the present invention, which is different from the embodiment of FIG. 1 in that, in addition to 3 leakage loss transmission lines 3*a*, 3*b*, and 3*c* constituting an antenna, a leakage loss transmission line 3*d* that is shorted at a distal end is connected to a power feed point 2.

According to this embodiment, it is possible to match a real part of the impedance of the antenna viewed from the power feed point 2 to the characteristic impedance of a high-frequency circuit, in addition to the 3 conditions that reactance is zero at the power feed point 2, that the amplitudes of mutually spatially perpendicular high-frequency induced currents are equal, and that the phase difference is 90 degrees, thus having the effect of efficiently radiating, from the antenna into space, power supplied from the high-frequency circuit (high-frequency power supply 1).

Another embodiment of the present invention will be explained referring to FIG. 5.

Figure 5:
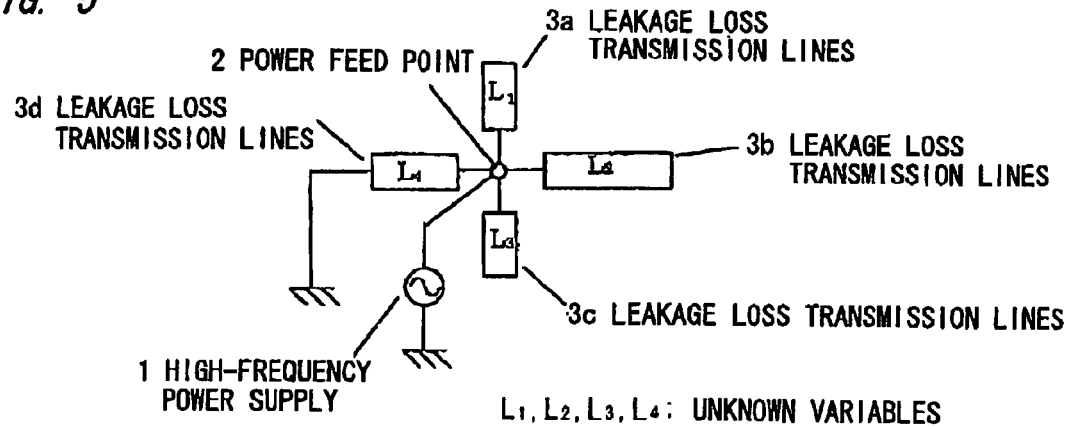
FIG. 5 is a configuration diagram of a leakage loss line type circularly-polarized wave antenna according to the present invention.

FIG. 5 is a diagram showing configuration of another embodiment of a leakage loss line type circularly-polarized wave antenna according to the present invention, which is different from the embodiment of FIG. 4 in that leakage loss transmission lines 3*a*-3*d* constituting an antenna are all open at a distal end, and therefore the effect similar to the effect of the embodiment of FIG. 3 to the embodiment of FIG. 1 can be added to the effect of the embodiment of FIG. 4.

Another embodiment of the present invention will be explained referring to FIG. 6.

Figure 6:
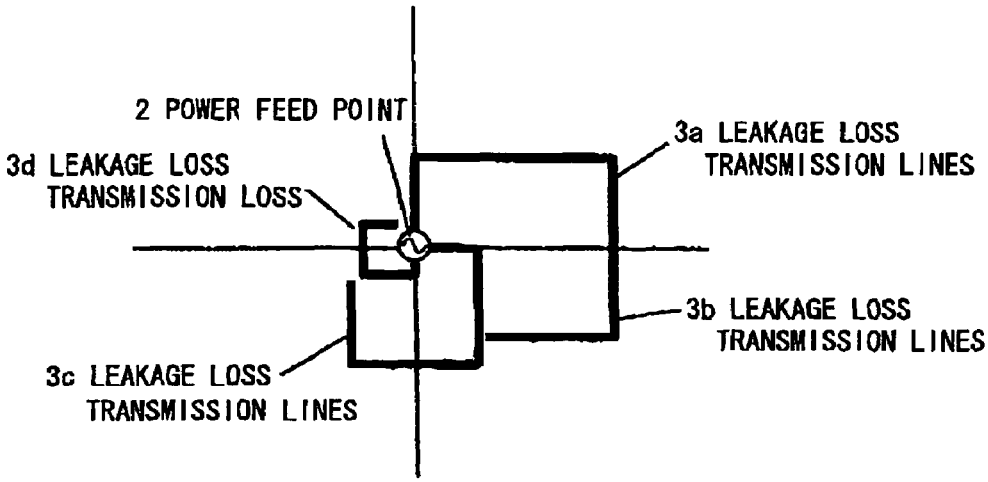
FIG. 6 is a structural diagram of a leakage loss line type circularly-polarized wave antenna according to the present invention.

FIG. 6 is a diagram showing structure of another embodiment of a leakage loss line type circularly-polarized wave antenna according to the present invention. While in the embodiment of FIG. 2, the leakage loss transmission lines 3*a*, 3*b*, and 3*a* constituting an antenna are bent in the U-shape formed from 3 equal segments, leakage loss transmission lines of this embodiment are bent in mutual similarity structure of a rectangle with one angle deleted therefrom.

Although not realizable for all combinations of L1, L2 and L3 shown in FIG. 1, this embodiment has the effect of further reducing size of antenna structure compared with the embodiment of FIG. 2, in the case of mutually separate L1, L2 and L3.

Another embodiment of the present invention will be explained referring to FIG. 7.

Figure 7:
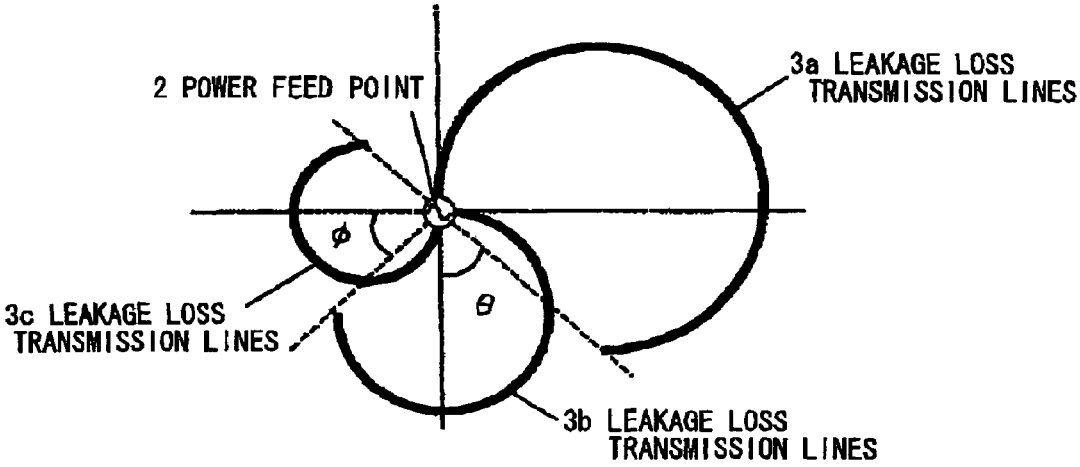
FIG. 7 is a structural diagram of a leakage loss line type circularly-polarized wave antenna according to the present invention.

FIG. 7 is a diagram showing structure of another embodiment of a leakage loss line type circularly-polarized wave antenna according to the present invention. While in the embodiment of FIG. 2, the leakage loss transmission lines 3*a*, 3*b*, and 3*c* constituting an antenna are bent in the U-shape formed from 3 equal segments, leakage loss transmission lines of this embodiment are bent in mutual similarity structure of a circular arc with a portion deleted therefrom.

Specifically, the leakage loss transmission lines 3*b* and 3*c* are connected to a power feed point 2 at a position rotated about the power feed point 2 by 90 degrees to the leakage loss transmission lines 3*a* and 3*b*, respectively. The segment that connects the open ends of the leakage loss transmission lines 3*a* and 3*c* is formed to pass through the power feed point 2, and incline by an angle θ to the diametrical segment of the leakage loss transmission lines 3*b* perpendicular to the diametrical segment that connects the two circles of the leakage loss transmission lines 3*a* and 3*c*. The segment that passes through the open end of the leakage loss transmission line 3*b* and the power feed point 2 is formed to incline by an angle ϕ to the diametrical segment that connects the two circles of the leakage loss transmission lines 3*a* and 3*c*.

Since the leakage loss transmission lines 3*a*, 3*b*, and 3*c* are curved smoothly in comparison to the embodiment of FIG. 6, this embodiment has the effect of more uniformly radiating a radio wave from the leakage loss transmission lines 3*a*, 3*b*, and 3*c* into space, thereby enhancing the radiating efficiency of the antenna.

Another embodiment of the present invention will be explained referring to FIG. 8.

Figure 8:
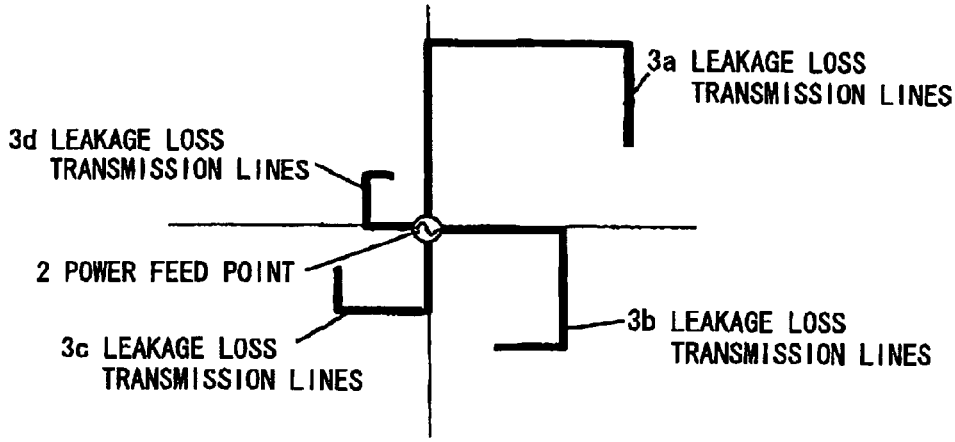
FIG. 8 is a structural diagram of a leakage loss line type circularly-polarized wave antenna according to the present invention.

FIG. 8 is a diagram showing structure of another embodiment of a leakage loss line type circularly-polarized wave antenna according to the present invention, which is different from the embodiment of FIG. 2 in that, in addition to 3 leakage loss transmission lines 3*a*, 3*b*, and 3*c* constituting an antenna, a leakage loss transmission line 3*d* is connected to a power feed point 2, and the 4 leakage loss transmission lines 3*a*-3*d* are bent in mutual similarity structure of a U-shape formed from unequal segments, and are formed in the entire shape of an inverted 卍.

Since the 4 leakage loss transmission lines 3*a*-3*d* are connected to the power feed point 2, this embodiment allows complete matching of the antenna and the high-frequency circuit at the power feed point 2, thereby enhancing the radiating efficiency of power supplied from the high-frequency circuit into space in comparison to the embodiment of FIG. 2.

Another embodiment of the present invention will be explained referring to FIG. 9.

Figure 9:
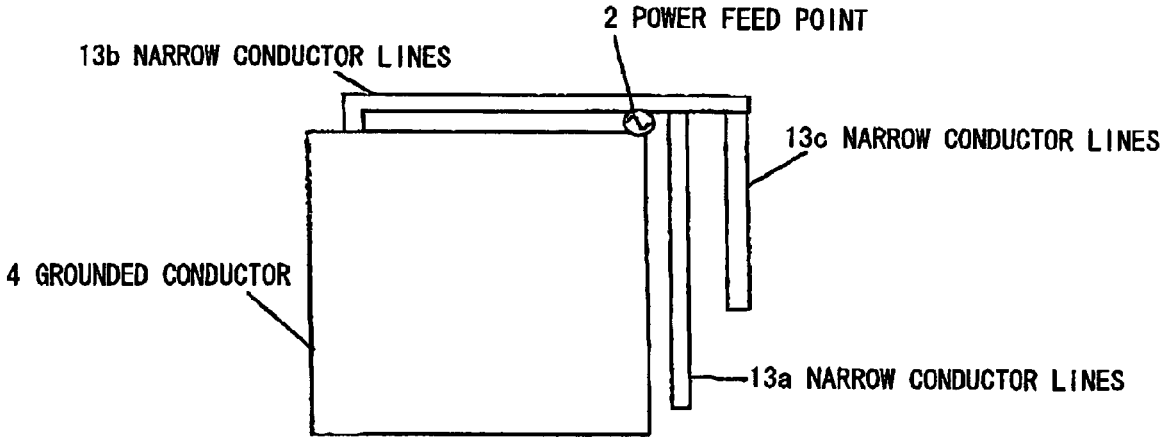
FIG. 9 is a substantial structural diagram of a leakage loss line type circularly-polarized wave antenna according to the present invention.

FIG. 9 is a diagram showing structure of another embodiment of a leakage loss line type circularly-polarized wave antenna according to the present invention, in which thin-width leakage loss transmission lines 13*a*, 13*b*, and 13*c* are formed coplanarly in a margin of a grounded plate conductor 4, and power is supplied at the power feed point 2 between the thin-width leakage loss transmission lines 13*a*, 13*b*, 13*c* and the grounded plate conductor 4.

The thin-width leakage loss transmission lines 13*a* and 13*c* are open at a distal end, while the leakage loss transmission lines 13*b* is shorted at a distal end electrically connected to the grounded plate conductor 4. The thin-width leakage loss transmission lines 13*a*-13*c* correspond to the leakage loss transmission lines 3*a*-3*c* in the previously-mentioned embodiments, and this embodiment may be implemented by providing a new fourth thin-width leakage loss transmission line as in the embodiments of FIGS. 4, 5 and 6 provided with the fourth thin-width leakage loss transmission line 3*d*.

Since the antenna itself structurally includes the grounded conductor 4, this embodiment allows antenna operation to be stabilized in an environment in which the conductor exists.

Another embodiment of the present invention will be explained referring to FIG. 10.

Figure 10:
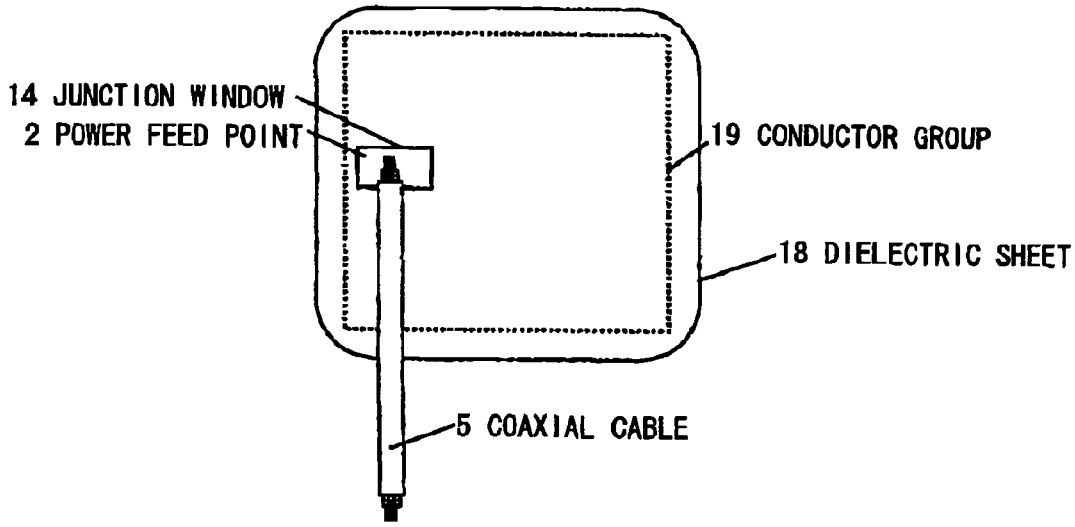
FIG. 10 is a substantial structural diagram of a leakage loss line type circularly-polarized wave antenna according to the present invention.

FIG. 10 is a diagram showing structure of another embodiment of a leakage loss line type circularly-polarized wave antenna according to the present invention, in which a power feed point 2 and a conductor group 19 comprising the set of thin-width conductor lines 3 (not illustrated), or the set of a grounded conductor 4 in some case are laminated with a thin dielectric sheet 18.

Also, a portion of the dielectric sheet 18 is provided with a junction window 14, so that the power feed point 2 is not covered with the dielectric sheet 18. In the junction window 14, one end of a coaxial cable 5 together with a core wire and coated wire is electrically connected to the power feed point 2.

Since the conductor group 19 is laminated with the thin dielectric sheet 19, the present invention can prevent conductor deterioration due to chemical reactions such as rusting, thereby having the effect of enhancing reliability of the antenna product. Also, the power feed point of the antenna can be drawn out by the coaxial cable 5, which therefore has the effect of increasing the degree of freedom of arrangement within the wireless device of the antenna and the high-frequency circuit that supplies high-frequency power to the antenna.

Another embodiment of the present invention will be explained referring to FIG. 11.

Figure 11:
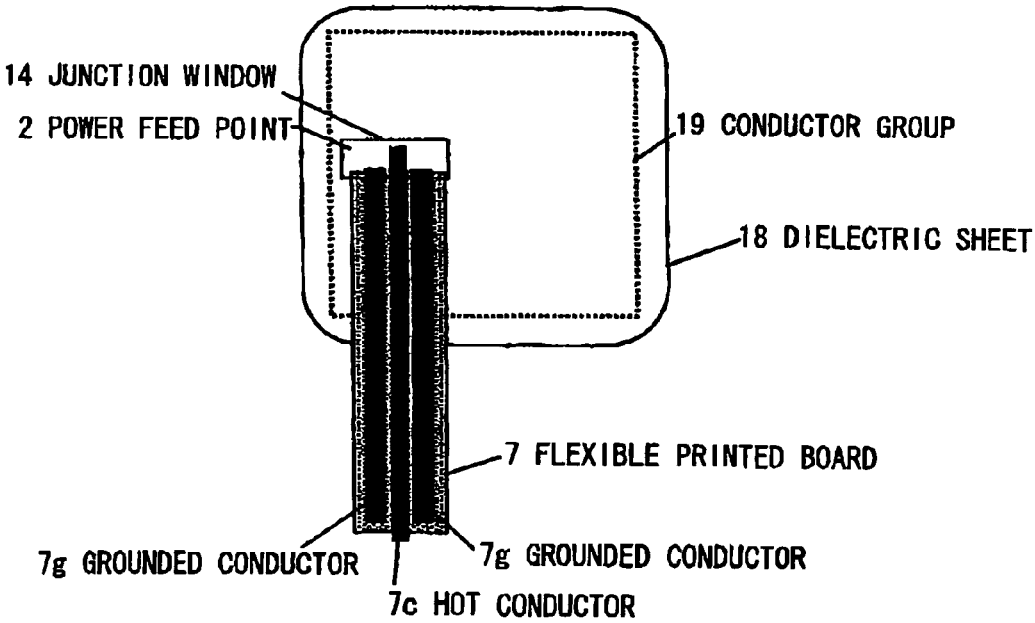
FIG. 11 is a substantial structural diagram of a leakage loss line type circularly-polarized wave antenna according to the present invention.

FIG. 11 is a diagram showing structure of another embodiment of a leakage loss line type circularly-polarized wave antenna according to the present invention, which is different from the embodiment of FIG. 10 in that a hot conductor 7*c* and a grounded conductor 7*g* of a coplanar line formed by a flexible printed board 7 are both electrically connected to a power feed point 2 in a junction window 14.

Since the flexible printed board 7 that is manufactured at low cost compared to the coaxial cable of FIG. 10 can be used as the power feed line, the manufacturing cost of the entire antenna can be reduced. Also, the power feed point 2 of the antenna can be drawn out by the flexible printed board 7, which therefore has the effect of increasing the degree of freedom of arrangement within the wireless device of the antenna and the high-frequency circuit that supplies high-frequency power to the antenna.

Another embodiment of the present invention will be explained referring to FIG. 12.

Figure 12:
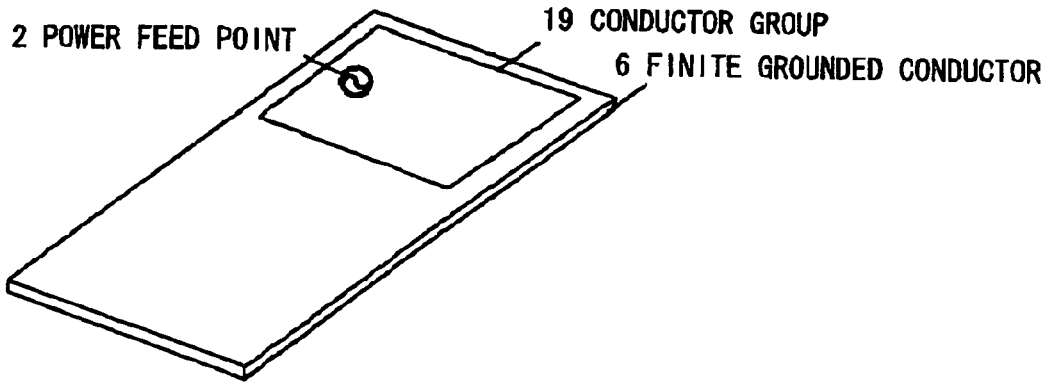
FIG. 12 is a substantial structural diagram of a leakage loss line type circularly-polarized wave antenna according to the present invention.

FIG. 12 is a diagram showing structure of another embodiment of a leakage loss line type circularly-polarized wave antenna according to the present invention, in which a conductor group 19 constituting the leakage loss line type circularly-polarized wave antenna of the embodiments of FIGS. 2, 6, 7, 8, and 9 is set on a finite grounded conductor 6 such as a circuit board.

In designing the leakage loss line type circularly-polarized wave antenna of the present invention, it is possible to incorporate an electromagnetic effect of the finite grounded conductor. By use of such a design method, antenna search is realized in which is incorporated a variation of characteristics during antenna mounting to the circuit board, thereby having the effect of inhibiting degradation of characteristics during antenna packaging into a wireless device.

Another embodiment of the present invention will be explained referring to FIG. 13.

Figure 13:
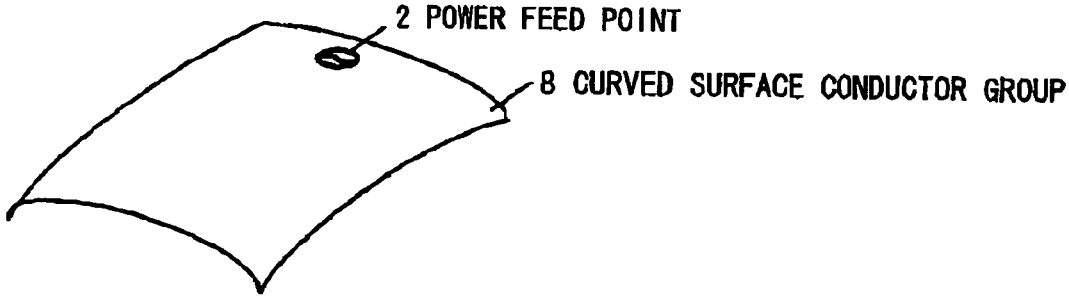
FIG. 13 is a substantial structural diagram of a leakage loss line type circularly-polarized wave antenna according to the present invention.

FIG. 13 is a diagram showing structure of another embodiment of a leakage loss line type circularly-polarized wave antenna according to the present invention, which is different from the embodiments of FIGS. 2, 6, 7, 8, 9, and 10 in that a curved surface 8 is used in place of the planar conductor group 19, which results in a curved surface antenna structure.

During packaging a distributed phase type circularly-polarized wave antenna into a wireless device, this embodiment allows flexible design modification of antenna structure according to packaging area shape resulting from wireless device design, thereby having the effect of enhancing the degree of freedom of design of the wireless device into which is packaged the leakage loss line type circularly-polarized wave antenna according to the present invention.

Another embodiment of the present invention will be explained referring to FIG. 14.

Figure 14A:
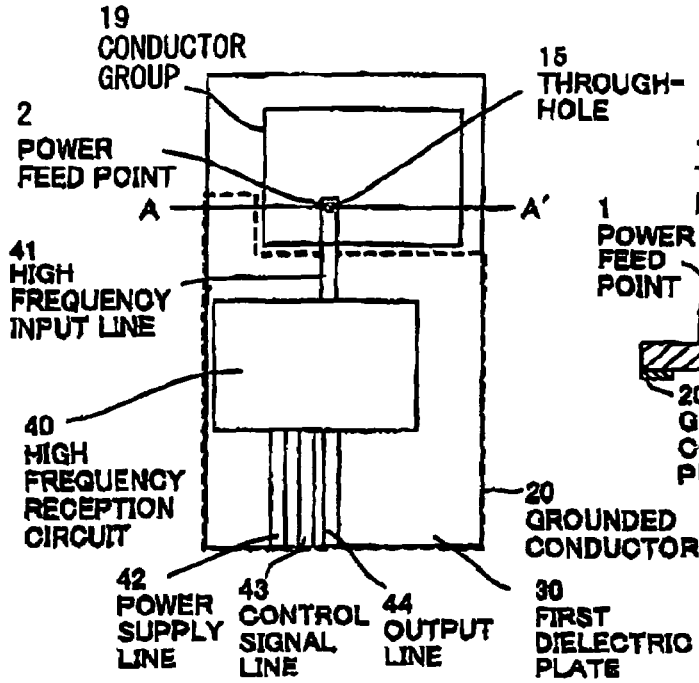
FIGS. 14A and 14B are a configuration diagram and a cross-sectional view, respectively, of one embodiment of a high-frequency module according to the present invention.
Figure 14B:
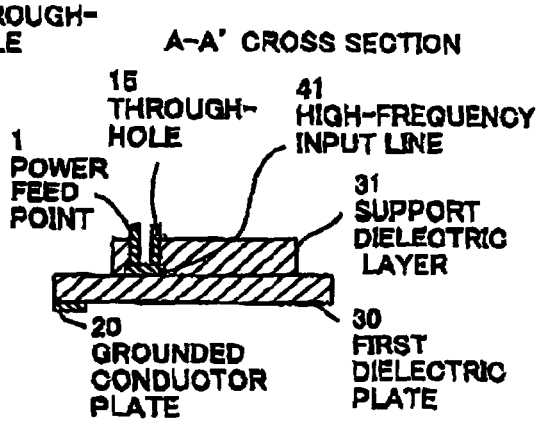

FIG. 14A is a plan view of a high-frequency module according to the present invention, and FIG. 14B is a cross-sectional view with respect to line A-A' of FIG. 14A.

In FIGS. 14A and 14B, a high-frequency reception circuit 40 that uses a grounded conductor plate 20 as a common ground potential plate is formed in a surface opposite the grounded conductor plate 20 of a dielectric plate 30, and includes a leakage loss line type circularly-polarized wave antenna structure shown by the conductor group 19 of FIGS.

2, 6, 7, 8, and 9, on the dielectric plate 30 via a support dielectric layer 31. In the opposite surface, a high-frequency input line 41 of the high-frequency reception circuit is formed and connected to a power feed portion 2 of a distributed phase type circularly-polarized wave antenna via a through hole 15 formed in the support dielectric layer 31, and there are formed a power supply line 42, a control signal line 43 and an output line 44 of the high-frequency reception circuit.

Where the power feed portion 2 of the distributed phase type circularly-polarized wave antenna is position in a margin of the conductor group 19, the through hole 15 is formed on a side of the support dielectric layer 31 as an end face through hole, thereby allowing connecting the power feed portion 2 and the high-frequency input line 41.

In this module, received signal voltage developed in the power feed portion 2 of the antenna is input to the high-frequency reception circuit 40 via the high-frequency input line 41, and by amplification, frequency discrimination and waveform shaping by a filter, frequency down-conversion, etc., is converted into an intermediate frequency or a base-band frequency, and supplied to outside the module via the output line 44.

The power supply and control signals of the high-frequency reception circuit 40 are respectively supplied from outside the module via the power supply line 42 and the control signal line 43.

Since the high-frequency reception module can be realized in thin structure integral with the antenna, this embodiment allows realization of volume reduction of the high-frequency reception module itself, freedom degree enhancement in mounting it into a wireless device and occupation volume reduction thereof inside the same wireless device, which consequently has the effect on size reduction and thinning of the wireless device.

Another embodiment of the present invention will be explained referring to FIG. 15.

Figure 15A:
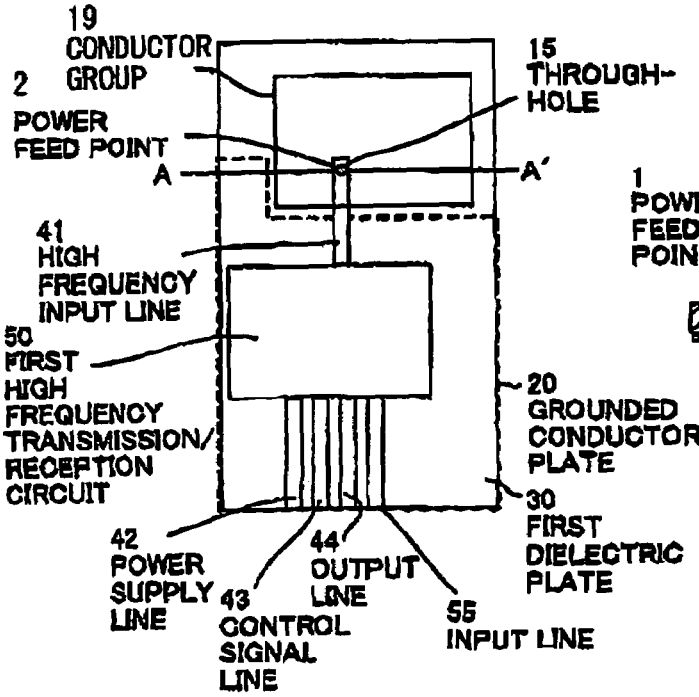
FIGS. 15A and 15B are a configuration diagram and a cross-sectional view, respectively, of one embodiment of a high-frequency module according to the present invention.
Figure 15B:
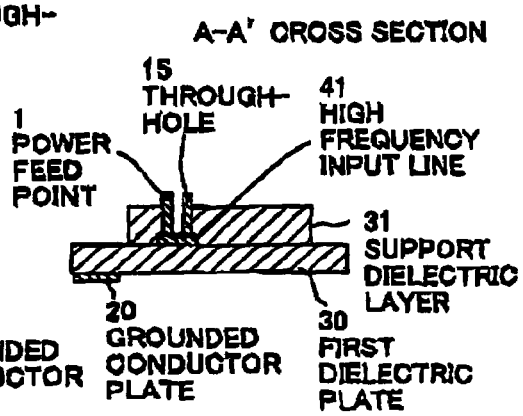

FIG. 15A is a plan view of a high-frequency module according to the present invention, and FIG. 15B is a cross-sectional view with respect to line A-A' of FIG. 15A.

The embodiment of FIGS. 15A and 15B is different from that of FIG. 14 in that a high-frequency transmission/reception circuit 50 is included in place of the high-frequency reception circuit 40, and in the high-frequency transmission/reception circuit 50, an input line 55 is formed in a surface opposite a grounded conductor plate 20 of a dielectric plate 30.

In this module, transmitted/received signal voltage developed in the power feed portion 2 of the antenna is input/output to the high-frequency transmission/reception circuit 50 via the high-frequency input line 41, and by amplification, frequency discrimination and waveform shaping by a filter, frequency down-conversion, etc., is converted into an intermediate frequency or a baseband frequency, so that signals are supplied to outside the module via the output line 44 or from outside the module via the input line 55.

The power supply and control signals of the transmission/reception circuit 50 are respectively supplied from outside the module via the power supply line 42 and the control signal line 43.

Since the high-frequency transmission/reception module can be realized in thin structure integral with the antenna, this embodiment allows realization of volume reduction of the high-frequency transmission/reception module itself, freedom degree enhancement in mounting it into a wireless device and occupation volume reduction thereof inside the same wireless device, which consequently has the effect on size reduction and thinning of the wireless device.

Another embodiment of the present invention will be explained referring to FIG. 16.

FIG. 16A is a plan view of a high-frequency module according to the present invention, FIG. 16B a backside view thereof and FIG. 16C a cross-sectional view with respect to line A-A' of FIG. 16A.

The embodiment of FIGS. 16A-16C is different from that of FIG. 15 in that a second dielectric plate 60 is formed in a surface different from a surface in which is formed a grounded conductor plate 20 of a dielectric plate 30; a second high-frequency transmission/reception circuit 62 is formed in a different surface opposite the surface in which is formed the grounded conductor plate 20 of the second dielectric plate 60; and signals and power of the first and second high-frequency transmission/reception circuits 50 and 62 are supplied to each other via a second through hole 61 formed in the dielectric plate 30 and the second dielectric plate 60.

Since the transmission/reception circuit is formed on both surfaces of the module in comparison to the embodiment of FIG. 15, this embodiment allows reduction of the area of the thin module, thereby having a significant effect on size reduction, i.e., entire volume reduction of a wireless device, rather than on thinning thereof.

Another embodiment of the present invention will be explained referring to FIG. 17.

Figure 17A:
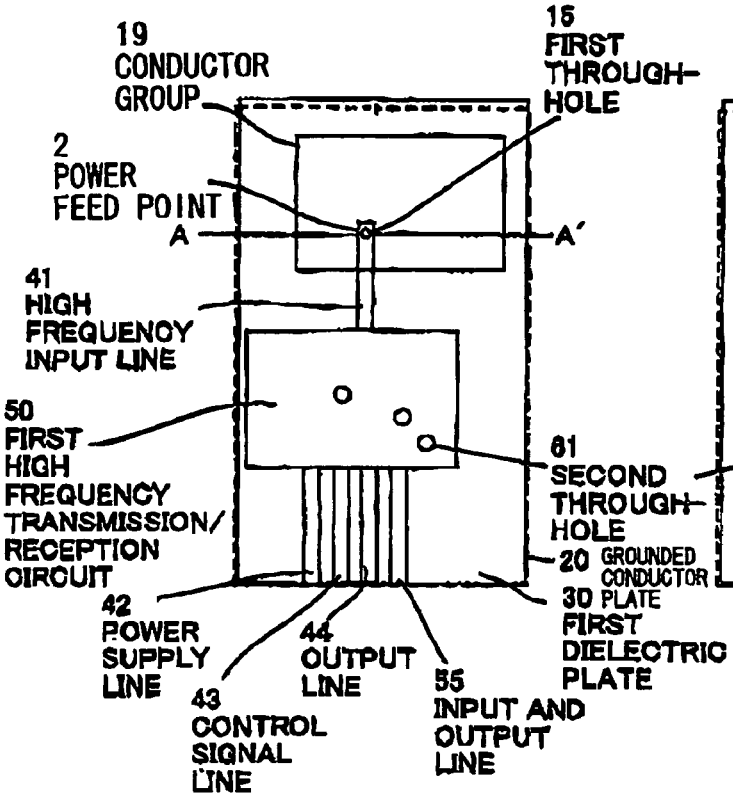
FIGS. 17A, 17D and 17C are a plan view, a backside view and a cross-sectional view, respectively, of a high-frequency module according to one embodiment of the present invention.
Figure 17B:
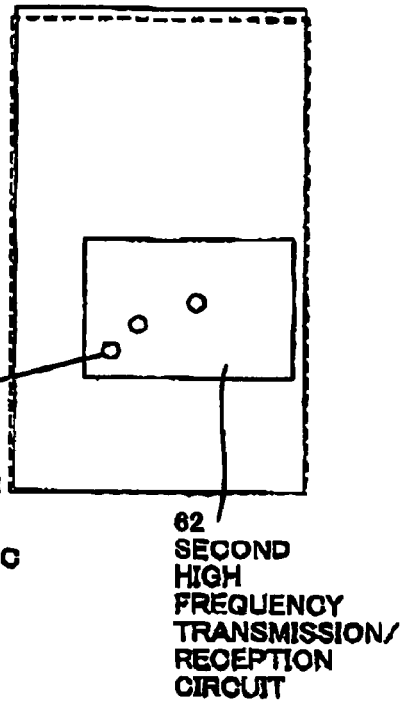
Figure 17C:
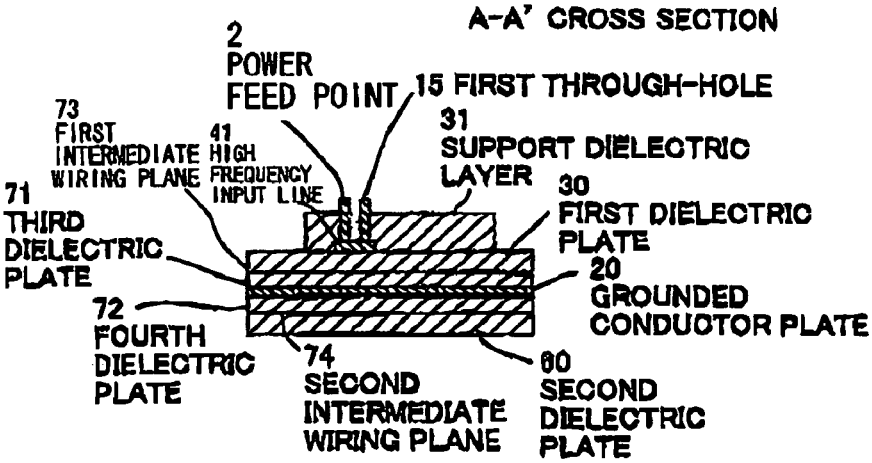

FIG. 17A is a plan view of a high-frequency module according to the present invention, FIG. 17B a backside view thereof and FIG. 17C a cross-sectional view with respect to line A-A' of FIG. 17A.

The embodiment of FIGS. 17A-17C is different from that of FIG. 16 in that a third dielectric plate 71 is formed between a grounded conductor plate 20 and a dielectric plate 30; a fourth dielectric plate 72 is formed between the grounded conductor plate 20 and a second dielectric plate 60; a first intermediate wiring surface 73 is formed in the junction surface between the first and third dielectric plates 30 and 71; a second intermediate wiring surface 74 is formed in the junction surface between the second and fourth dielectric plates 60 and 72; and signals and power of the first and second high-frequency transmission/reception circuits 50 and 62 are supplied to each other via a second through hole 61 formed in the dielectric plate 30 and the second dielectric plate 60, a wiring pattern formed in the first intermediate wiring surface 73, and a wiring pattern formed in the second intermediate wiring surface 74.

Since the wiring pattern forming the high-frequency transmission/reception circuit is formed inside the module as well as on both surfaces of the module in comparison to the embodiment of FIG. 16, this embodiment allows further reduction of the area of the thin module, thereby having a significant effect on size reduction, i.e., entire volume reduction of a wireless device, rather than on thinning thereof.

Another embodiment of the present invention will be explained referring to FIG. 18.

Figure 18:
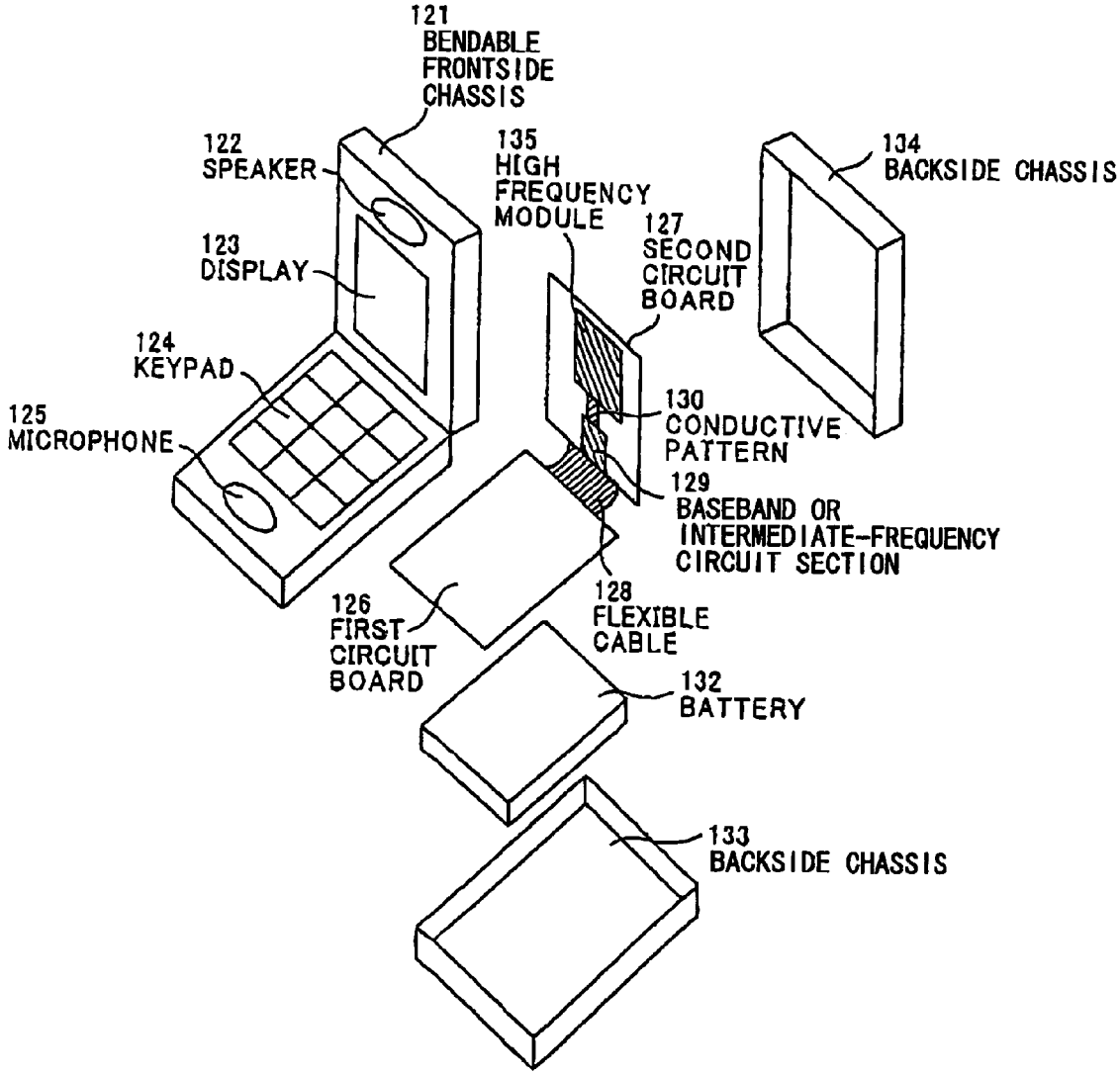
FIG. 18 is a diagram showing one structure of a radio terminal into which is incorporated a high-frequency module according to the present invention.

FIG. 18 is a diagram showing configuration of a communication device into which is incorporated a high-frequency module according to an embodiment of the present invention, in which a bendable front side chassis 121 is mounted with a speaker 122, a display 123, a keypad 124, and a microphone 125. A baseband or intermediate frequency circuit section 129 and a high-frequency module 135 of the present invention are mounted on first and second circuit boards 126 and 127 connected by a flexible cable 128 housed in the chassis 121. There is formed a conductor pattern 130 that connects signals of the baseband or intermediate frequency circuit section 129 and the high-frequency module 135, control signals, and a power supply. The device, along with a battery 132, is housed by means of first and second backside chasses 133 and 134.

This structure is characterized in that the high-frequency module 135 of the present invention is positioned in an opposite direction of the display 123 or the speaker 122 via the circuit board 127.

Since a wireless terminal that receives services of plural wireless systems can be realized in a built-in antenna form, this embodiment has a significant effect on size reduction of the wireless terminal and enhancement of users convenience during storage and carrying.

Another embodiment of the present invention will be explained referring to FIG. 19.

Figure 19:
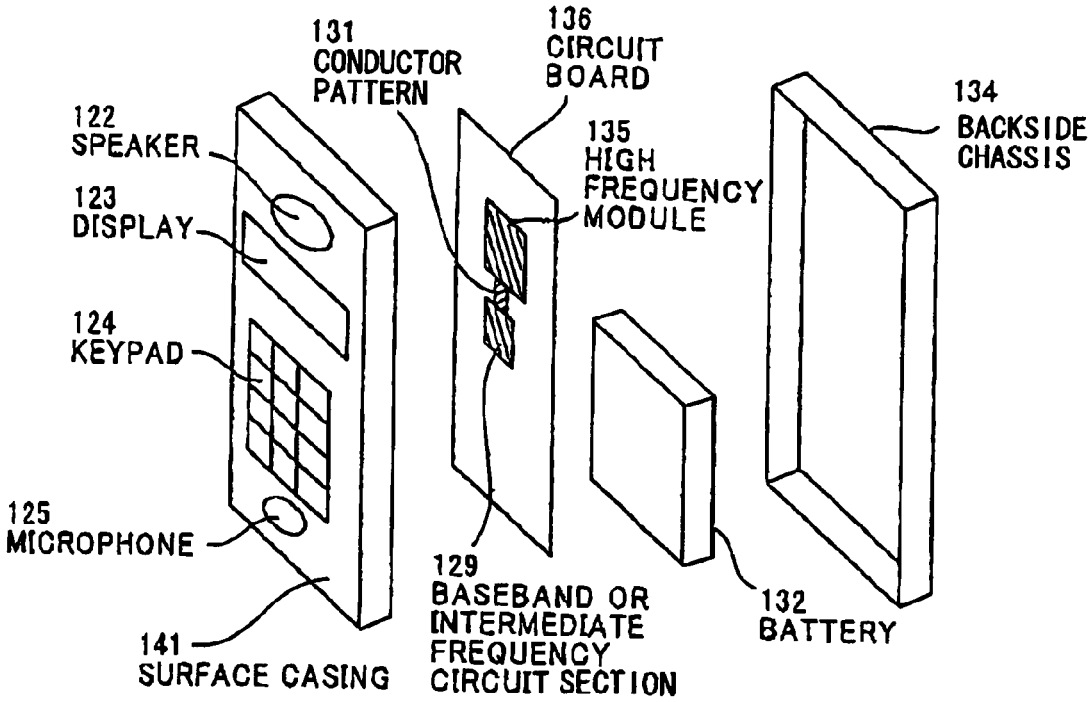
FIG. 19 is a diagram showing one structure of a radio terminal into which is incorporated a high-frequency module according to the present invention.

FIG. 19 is a diagram showing configuration of a communication device into which is incorporated an antenna element according to another embodiment of the present invention. A front side chassis 141 is mounted with a speaker 122, a display 123, a key pad 124, and a microphone 125. A baseband or intermediate frequency circuit section 129 and a high-frequency module 135 of the present invention are mounted on a circuit board 136 housed in the chassis 141. There is formed a conductor pattern 131 that connects signals of the baseband or intermediate frequency circuit section 129 and the high-frequency module 135, control signals, and a power supply. The device, along with a battery 132, is housed by means of a backside chassis 134.

This structure is characterized in that the antenna element of the present invention is positioned in an opposite direction of the display 123 or the microphone 125 or the speaker 122 or the key pad 124 via the circuit board 136.

Since a wireless terminal that receives services of plural wireless systems can be realized in a built-in antenna form, this embodiment has a significant effect on size reduction of the wireless terminal and enhancement of users convenience during storage and carrying.

Also, compared with the embodiment of FIG. 18, the circuit board and the chassis are made integrally, which therefore has an effect on reducing manufacturing cost because of reductions in terminal volume size and in the number of assembly steps.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A leakage loss line type circularly-polarized wave antenna, comprising:

at least three conductor lines including losses by electromagnetic radiation, the at least three conductor lines being connected to a single power feed point, the power feed point comprising a signal line connection point electrically connected to a signal line, and a ground line connection point electrically connected to a ground line, wherein:

the conductor lines are projected onto a plane perpendicular to a straight line that connects the power feed point and one point in a distance from the power feed point, the signal line connection point, the ground line connection point, and the conductor lines are coplanar, a sum of the projections of high-frequency current induced on the conductor lines onto any two orthogonal axes set on a plane of complex vectors is taken for each axis, a ratio of absolute values for the amplitude of each sum is 0.7-1.3, and an absolute value of the phase difference in the axes is 80-100 degrees.

2. The leakage loss line type circularly-polarized wave antenna according to claim 1, further comprising a finite grounded conductor, wherein one end of at least one of the conductor lines is grounded to the grounded conductor.

3. The leakage loss line type circularly-polarized wave antenna according to claim 2, wherein the finite grounded conductor and the conductor lines are coplanar.

4. The leakage loss line type circularly-polarized wave antenna according to claim 1, further comprising a finite grounded conductor, wherein the conductor lines are all open at the other end to a power feed side.

5. The leakage loss line type circularly-polarized wave antenna according to claim 4, wherein the finite grounded conductor and the conductor lines are coplanar.

6. The leakage loss line type circularly-polarized wave antenna according to claim 1, wherein the projection of each conductor line onto the plane is curved at a same ratio and in a same direction.

7. The leakage loss line type circularly-polarized wave antenna according to claim 6, wherein a curved shape of each one of the conductor lines comprises a circular continuous portion.

8. The leakage loss line type circularly-polarized wave antenna according to claim 1, wherein the projection of each conductor line onto the plane is bent at a same ratio and in a same direction.

9. The leakage loss line type circularly-polarized wave antenna according to claim 8, wherein a bent shape of each conductor line comprises a square continuous portion.

10. The leakage loss line type circularly-polarized wave antenna according to claim 1, wherein the number of the conductor lines is three.

11. The leakage loss line type circularly-polarized wave antenna according to claim 1, wherein the number of the conductor lines is four.

12. The leakage loss line type circularly-polarized wave antenna according to claim 1, wherein each conductor line is formed on a conductor plate including finite ground potential.

13. The leakage loss line type circularly-polarized wave antenna according to claim 12, wherein a space between each conductor line and the conductor plate is filled with a dielectric.

14. The leakage loss line type circularly-polarized wave antenna according to claim 13, comprising a dielectric-stacked conductor formed on a surface in a power feed portion direction of the grounded conductor plate, and a conductor connected to the power feed portion formed inside the dielectric, and electrically connected to a stacked conductor.

15. The leakage loss line type circularly-polarized wave antenna according to claim 13, comprising a dielectric-stacked conductor is formed on a surface in a power feed portion direction of the grounded conductor plate, and a conductor connected to the power feed portion is formed on a side of the dielectric, and electrically connected to a stacked conductor.

16. A high-frequency module, comprising the leakage loss line type circularly-polarized wave antenna according to claim 13.

17. A mobile wireless device, comprising the leakage loss line type circularly-polarized wave antenna according to the high-frequency module according to claim 16.

18. The leakage loss line type circularly-polarized wave antenna according to claim 12, wherein a space between each conductor line and the conductor plate is filled with a magnetic material.

19. The leakage loss line type circularly-polarized wave antenna according to claim 18, comprising a magnetic material-stacked conductor formed on a surface in a power feed portion direction of the grounded conductor plate, and a conductor connected to the power feed portion formed inside the magnetic material, and electrically connected to a stacked conductor.

20. The leakage loss line type circularly-polarized wave antenna according to claim 18, comprising a magnetic material-stacked conductor formed on a surface in a power feed portion direction of the grounded conductor plate, and a conductor connected to the power feed portion formed on a side of the magnetic material, and electrically connected to a stacked conductor.

21. The leakage loss line type circularly-polarized wave antenna according to claim 1, wherein an antenna structure is laminated with a thin dielectric sheet.

22. The leakage loss line type circularly-polarized wave antenna according to claim 1, wherein one end of a coaxial cable is connected to the power feed point, while the other end is a power feed point for external connection.

23. The leakage loss line type circularly-polarized wave antenna according to claim 1, wherein one end of a flexible print cable is connected to the power feed point, while the other end comprises a power feed point for external connection.

24. A mobile wireless device, comprising the leakage loss line type circularly-polarized wave antenna according to claim 1.

25. A leakage loss line type circularly-polarized wave antenna, comprising:

at least three conductor lines having losses caused by electromagnetic radiation and being connected to a single power feed point, wherein:

the conductor lines are projected onto a plane perpendicular to a straight line that connects the power feed point and one point in a distance from the power feed point, the projection of each conductor line onto the plane is curved at a same ratio and in a same direction, the sum of the projections of high-frequency current induced on the conductor lines onto any two orthogonal axes set on the plane of complex vectors is taken for each axis, the ratio of the absolute values for the amplitude of each sum is 0.7-1.3, an absolute value of the phase difference in the axes is 80-100 degrees, and an entire length of the conductor lines are different from one another.

26. A leakage loss line type circularly-polarized wave antenna, comprising:

at least three conductor lines having losses caused by electromagnetic radiation and being connected to a single power feed point, wherein:

the conductor lines are projected onto a plane perpendicular to a straight line that connects the power feed point and one point in the distance, the projection of each conductor line onto the plane is bent at the same ratio and in the same direction, a sum of the projections of high-frequency current induced on the conductor lines onto any two orthogonal axes set on the plane of complex vectors is taken for each axis, a ratio of the absolute values for the amplitude of each sum is 0.7-1.3, an absolute value of the phase difference in the axes is 80-100 degrees, and an entire length of the conductor lines are different from one another.

* * * * *